United States Patent [19]

Maike et al.

[11] 4,421,478

[45] Dec. 20, 1983

[54] HIGH EFFICIENCY FUEL BURNER

[75] Inventors: Bruce R. Maike, Westerville; Carl S. Fladt; Frank E. Lavely, both of Galloway, all of Ohio

[73] Assignee: Magic Chef, Inc., Cleveland, Tenn.

[21] Appl. No.: 289,283

[22] Filed: Aug. 3, 1981

[51] Int. Cl.[3] ..... F23D 15/00

[52] U.S. Cl. ..... 431/351; 431/187; 431/354; 239/552

[58] Field of Search ..... 431/179, 181, 187, 188, 431/349, 351, 354; 239/552, 554, 555; 126/39 E

[56] References Cited

U.S. PATENT DOCUMENTS

| | | | |
|---|---|---|---|
| 826,148 | 7/1906 | Croxton | 431/188 |
| 1,406,925 | 2/1922 | Britten | 431/346 |
| 1,419,054 | 6/1922 | Ionides, Jr. | 431/187 |
| 1,426,697 | 8/1922 | Windle | 239/419.3 |
| 1,862,673 | 6/1929 | Foster | 431/187 |
| 2,269,333 | 1/1942 | Bloom | 431/188 |
| 2,428,274 | 9/1944 | Flynn et al. | 158/99 |
| 2,647,569 | 8/1951 | Flynn | 158/116 |
| 2,918,967 | 12/1956 | Hays et al. | 158/116 |
| 3,152,635 | 10/1964 | Cox et al. | 431/349 |
| 3,156,292 | 11/1961 | Ross | 158/114 |
| 3,162,237 | 12/1961 | Brown et al. | 158/99 |
| 3,241,542 | 3/1962 | Lotter | 126/39 |
| 3,446,566 | 5/1969 | Miller | 431/349 |
| 3,468,298 | 9/1967 | Teague, Jr. et al. | 126/39 |
| 3,494,350 | 2/1968 | Perl | 126/39 |
| 3,499,720 | 3/1968 | Flynn | 431/349 |
| 3,837,788 | 9/1974 | Craig et al. | 431/351 |
| 3,885,903 | 5/1975 | La Haye | 431/351 X |
| 4,172,445 | 10/1979 | Sellers | 431/351 X |

*Primary Examiner*—Samuel Scott
*Assistant Examiner*—Margaret A. Focarino
*Attorney, Agent, or Firm*—Bacon & Thomas

[57] ABSTRACT

A burner for gaseous fuel having an air supply chamber maintained at a predetermined uniform pressure and ports leading to at least three separate chambers in a burner assembly. The first of these ports receives a mixture of fuel and air from the supply chamber and directs the same through a first chamber to burner ports in the assembly. The other two chambers receive secondary air from the air supply chamber and direct it to positions closely adjacent opposite sides of the burner ports. The burner ports are arranged in rows and the first chamber is of tapered section along the rows of burner ports.

7 Claims, 3 Drawing Figures

HIGH EFFICIENCY FUEL BURNER

BACKGROUND OF THE INVENTION

This invention is in the field of burners and particularly gaseous fuel burners for furnaces.

Heretofore furnace burners were often operated under ambient atmospheric conditions where gas and primary air were mixed in a venturi and an excess of secondary air was supplied to the combustion chamber. The drawback to using this approach is that all excess air, which must be supplied to ensure proper combustion, increases flue losses and thus reduces the unit efficiency.

There has also been used power burners having a single port, where gas and air are mixed in a chamber. The gas and air mixture is then burned in a concentrated flame at a single location. The drawback to using this approach is that the flame is concentrated in one location instead of being spread over a large area of heating surface.

It has also been proposed to supply secondary air to a gaseous fuel burner by directing secondary air along a path different from the path followed by the fuel and air mixture. See, for example, the U.S. patent to Ross No. 3,156,292 and also see the U.S. patent to Craig et al No. 3,837,788 wherein the primary air for combustion and the secondary air is supplied from a common chamber. The U.S. patents to Flynn and Flynn et al Nos. 2,428,274, 3,499,720, and 2,647,569 propose to construct burners from sheet metal components.

SUMMARY OF THE INVENTION

The present invention involves a novel arrangement wherein air is maintained under predetermined pressure in an air supply chamber and a gas conduit is directed through that chamber into a mixing tube which is also exposed to the interior of the air supply chamber so that a predetermined mixture of gas and air is made and directed into a first chamber in a burner assembly from whence it is directed to rows of burner ports. Second and third chambers in the assembly also communicate with the air supply chamber, but separately, and direct air to secondary air ports closely adjacent to rows of burners of burner ports. The secondary air is distributed along the length of the burner port rows and the structure is of a simple nature, easy to construct and assemble, and formed essentially of only bent sheet metal components. The orifices directing secondary air from the air supply chamber into the burner assembly chambers may be of predetermined size, thus metering the amount of secondary air and enabling a close approach to stoichiometric combustion. The burner operation provides good flame pattern and obtains improved heat transfer to the combustion chamber wall and the elimination of all hot spots in the chamber.

DESCRIPTION OF THE PREFERRED EMBODIMENTS

Figure 1:
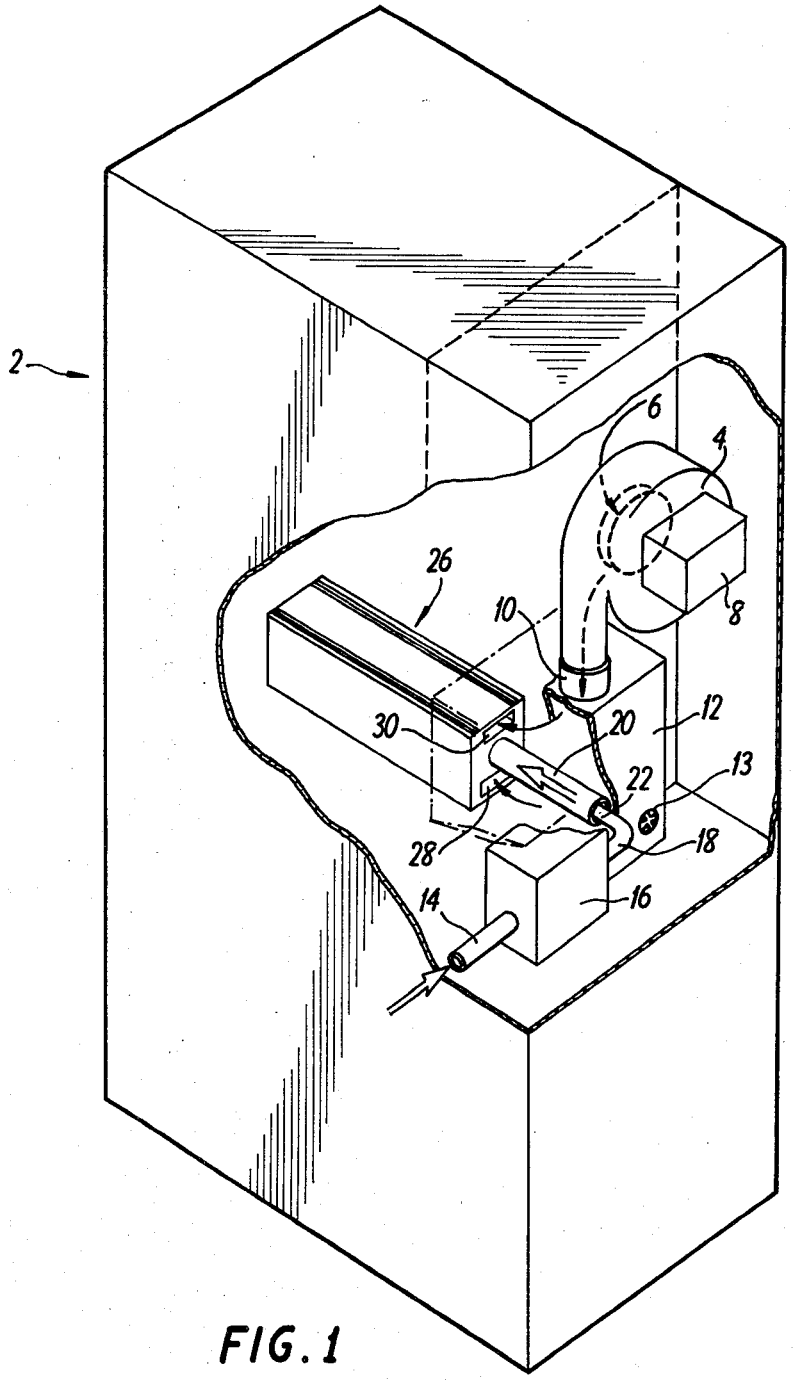
FIG. 1 is a schematic perspective view of a furnace embodying the present invention.

Referring first to FIG. 1, numeral 2 designates generally a furnace embodying the present invention. It is contemplated that the furnace shall include a suitable heat exchanger and air circulating means for directing air to be heated over the heat exchanger, the heated air to be distributed throughout an enclosed space to be heated. Such features are omitted from the drawings for clarity. However, there is a showing of a blower (4) having an inlet (6) for air and driven by a motor (8). The air from the blower (4) is directed through a metering orifice at (10), into an air supply chamber (12) wherein a uniform air pressure is maintained and which may be regulated by a suitable control indicated at (13).

Figure 2:
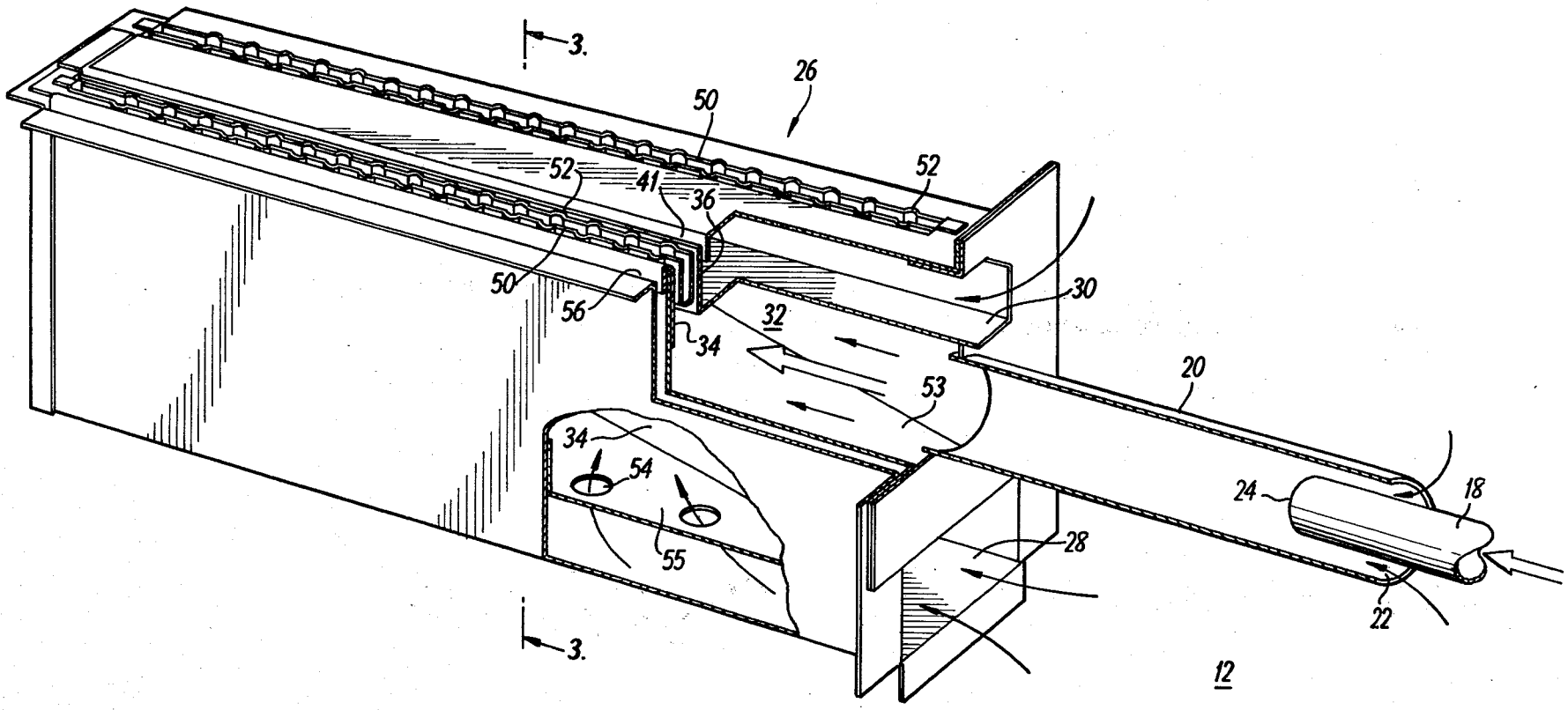
FIG. 2 is an enlarged perspective view of the burner assembly of the present invention.

Numeral (14) indicates a supply tube or conduit for gaseous fuels from a suitable source, and which extends through a fuel control valve arrangement (16), into a conduit (18) extending into a tube (20) having an open end (22) in the air supply chamber (12). As shown in FIG. 2, the conduit (18) terminates in a suitable metering orifice at (24) within the tube (20). As shown, the conduit (18) is of lesser diameter than the inner dimension of the tube (20) so that air from chamber (12) may enter the tube (20) to be mixed with gaseous fuel issuing from the orifice (24). The tube (20) extends into a first of three chambers in the burner assembly, as indicated generally at (32) in FIG. 2. An end wall of the assembly (26) is provided with secondary air inlet openings (28 and 30) communicating with the air supply chamber (12). The inlet opening (30) communicates with a second chamber (42) within the assembly (26) whereas the inlet opening (28) communicates with a third chamber (44) within the assembly.

Figure 3:
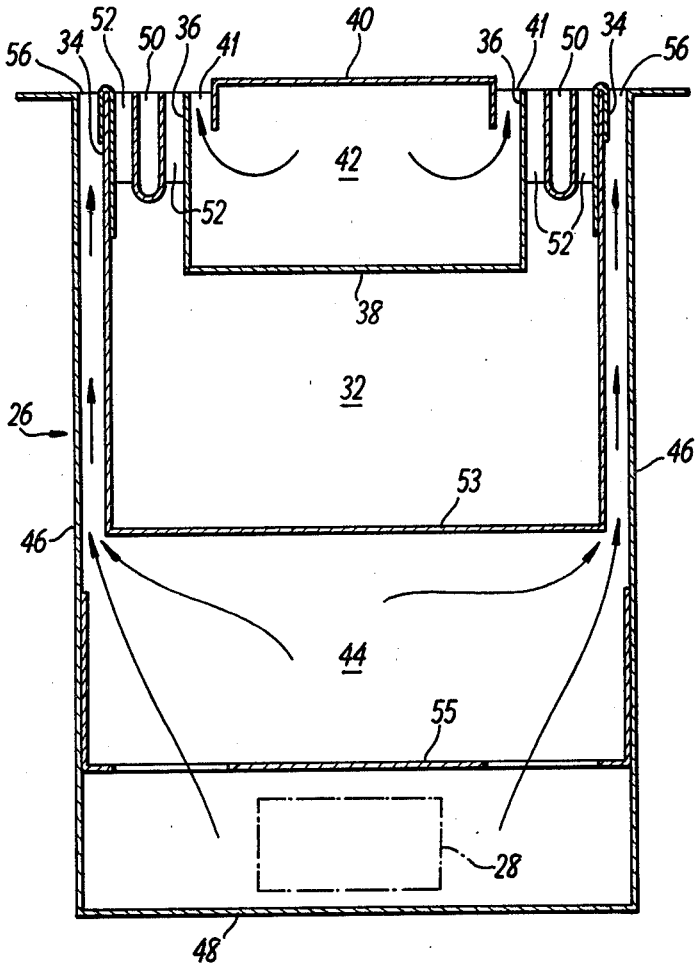
FIG. 3 is a further enlarged transverse sectional view taken substantially on the line 3—3 of FIG. 2.

Referring now particularly to FIGS. 2 and 3, the tube (20) communicates with the first chamber (32) in the assembly (26) and which chamber is of generally U-shape having upstanding legs defined by spaced walls (34) and (36). The walls (36) are upstanding legs of a U-shaped structure including a bottom wall (38) which along with a cover plate (40) defines the second chamber (42) having outlets or ports (41) closely adjacent the walls (36). It is to be noted that the chamber (42) is between the legs of the chamber (32). A third chamber (44) is defined by the outer walls (46) and bottom wall (48) of the burner assembly (26) and this chamber also is generally U-shape having upstanding legs defined by the space between the outer walls (46) and the walls (34). Thus, the three chambers have common walls, are each of generally U-shape with upstanding legs, and mutually nested.

Sheet metal inserts (50) (best seen in FIG. 2) are positioned between the walls (36 and 34) and each is provided with outwardly extending integral ribs (52) frictionally engaging the walls (34 and 36), respectively). The ribs may be secured in any suitable manner to the walls (34 and 36), or they may be merely frictionally engaged therewith and the spaces between the ribs (52) define burner ports, through which the gaseous fuel and air mixture flows from first chamber (32) to be burned in the space above the burner assembly.

It is to be noted that the ports (56) communicate with chamber (44) and ports (41) communicate with chamber (42), thus secondary air is directed to positions closely adjacent and along the length of the rows of burner ports and thus may be metered by regulating the size of the ports (56) and (41) to achieve substantially stoichiometric combustion.

From FIG. 2 it can be seen that the bottom wall (53) of chamber (32) slopes upwardly toward the burner ports in a direction away from the air supply chamber (12) and toward the remote ends of the rows of burners. Thus, the distribution of pressurized fuel and air mixture throughout the length of the first chamber (32) is substantially uniform from end to end.

Inlet opening (28) communicates with the lower portion of the chamber (44) as indicated by broken line in FIG. 3 and a partition (55) extends across that chamber as shown in FIGS. 2 and 3. The partition (55) is provided with openings (54) whereby to distribute the secondary air uniformly from the lower portion of chamber (44) throughout the length thereof so that secondary air is uniformly distributed in the outer secondary air ports (56).

It is to be noted that the burner design herein described has advantages in the versatility wherein its length can be increased or decreased to fit different heat exchange applications. The number of burner channels and secondary air channels can be varied depending upon the heating output required. For example, one burner channel can be utilized for low output furnaces and several burner channels and secondary air channels can be incorporated for use in high output models.

While a single specific embodiment of the invention has been shown and described herein, the same is merely illustrative of the principles involved and other forms may be resorted to within the scope of the appended claims.

What we claim is:

1. In a burner having an air supply chamber and means for maintaining a predetermined air pressure in said chamber, the improvement comprising:

a fuel tube having an open end in said air supply chamber and a fuel supply conduit extending into said tube and having a fuel discharge orifice in said fuel tube;

a burner assembly adjacent said supply chamber and comprising a housing having at least three burner chambers therein;

said fuel tube opening into a first of said burner chambers and plural burner ports communicating with said first burner chamber;

a separate metering port from said air supply chamber to each of the second and third burner chambers; and each of said second and third burner chambers communicating with secondary air ports disposed closely adjacent said plural burner ports whereby a mixture of fuel and primary air is directed through said first burner chamber to said plural burner ports and metered secondary air is directed through said second and third burner chambers to positions closely adjacent said plural burner ports to provide a flame spread over an area of heating surface.

2. In a burner having an air supply chamber and a means for maintaining a predetermined air pressure in said chamber, the improvement comprising:

a fuel tube having an open end in said air supply chamber and a fuel supply conduit extending into said tube and having a fuel discharge orifice in said fuel tube;

a burner assembly adjacent said supply chamber and comprising a housing having at least three burner chambers therein;

said fuel tube opening into a first of said burner chambers and burner ports communicating with said first burner chamber;

a separate metering port from said air supply chamber to each of the second and third burner chambers;

each of said second and third burner chambers communicating with secondary air ports disposed closely adjacent said burner ports whereby a plurality of fuel and primary air is directed through said first burner chamber to said burner ports and metered secondary air is directed through said second and third burner chambers to positions closely adjacent said burner ports; and wherein said first burner chamber is of generally U-shape in cross section, the legs thereof communicating with spaced rows of burner ports, said second burner chamber being disposed between said legs with said secondary air ports adjacent one side of each of said rows of burner ports, and the third burner chamber being of generally U-shape in cross section and embracing said first burner chamber, the legs of which are provided with said secondary air ports extending along the other sides of each of said rows of burner ports.

3. A burner as defined in claim 2 wherein a bottom wall of said first burner chamber slopes upwardly from the portion thereof adjacent said air supply chamber whereby said first chamber decreases in sectional area along the length of said rows of burner ports.

4. A burner as defined in claim 3 including means in said third burner chamber to equalize flow of secondary air therefrom to said burner ports.

5. A burner as defined in claim 4 wherein said means comprises a perforated partition in said third chamber extending across the flow path from the port from said supply chamber to said burner ports.

6. In a burner having an air supply chamber and means for maintaining a predetermined air pressure in said chamber, the improvement comprising:

a fuel tube having an open end in said air supply chamber and a fuel supply conduit extending into said tube and having a fuel discharge orifice in said tube;

a burner assembly adjacent said supply chamber and comprising a housing having at least three burner chambers therein;

said fuel tube opening into a first of said burner chambers and burner ports communicating with said first burner chamber;

a separate metering port from said air supply chamber to each of the second and third burner chambers;

each of said second and third burner chambers communicating with ports closely adjacent said burner ports whereby a mixture of fuel and primary air is directed through said first burner chamber to said burner ports and metered secondary air is directed through said second and third burner chambers to positions closely adjacent said burner ports;

wherein the first burner chamber is of generally U-shape in cross section having upstanding legs which are defined by spaced parallel walls;

an insert, of less width than the space between said walls, positioned substantially centrally between said walls; and a plurality of spacers spaced between said insert and said walls, the spaces between said spacers defining said burner ports.

7. A burner as defined in claim 6 wherein said insert comprises a generally U-shaped strip of sheet metal, said spacers being integral ribs formed in the sides thereof.

* * * * *